US006007909A

United States Patent [19]

Rolander et al.

[11] Patent Number: 6,007,909

[45] Date of Patent: Dec. 28, 1999

[54] CVD-COATED TITANIUM BASED CARBONITRIDE CUTTING TOLL INSERT

[75] Inventors: Ulf Rolander, Bromma; Gerold Weinl, Älvjsö ; Björn Lundberg, Enskede, all of Sweden

[73] Assignee: Sandvik AB, Sandviken, Sweden

[21] Appl. No.: 08/981,844

[22] PCT Filed: Jul. 19, 1996

[86] PCT No.: PCT/SE96/00963

§ 371 Date: Feb. 9, 1998

§ 102(e) Date: Feb. 9, 1998

[87] PCT Pub. No.: WO97/04143

PCT Pub. Date: Feb. 6, 1997

[30] Foreign Application Priority Data

Jul. 24, 1995 [SE] Sweden ..... 9502687

[51] Int. Cl.[6] ..... C23C 16/30; B23B 27/14

[52] U.S. Cl. ..... 428/336; 428/469; 428/472; 428/698; 428/701; 428/702; 428/704; 51/298; 51/307; 51/309

[58] Field of Search ..... 428/336, 698, 428/704, 701, 702, 469, 472; 51/295, 307, 309

[56] References Cited

U.S. PATENT DOCUMENTS

| | | | |
|---|---|---|---|
| 4,447,263 | 5/1984 | Sugizawa et al. | 75/233 |
| 5,123,934 | 6/1992 | Katayama et al. . | |
| 5,135,801 | 8/1992 | Nyström et al. . | |
| 5,250,367 | 10/1993 | Santhanam et al. | 428/698 |
| 5,306,326 | 4/1994 | Oskarsson et al. | 75/238 |
| 5,330,553 | 7/1994 | Weinl et al. | 72/236 |
| 5,336,292 | 8/1994 | Weinl et al. | 75/230 |
| 5,372,873 | 12/1994 | Yoshimura et al. | 428/216 |
| 5,376,466 | 12/1994 | Koyama et al. . | |
| 5,395,680 | 3/1995 | Santhanam et al. . | |
| 5,436,071 | 7/1995 | Odani et al. . | |
| 5,705,263 | 1/1998 | Lenander et al. . | |
| 5,851,687 | 12/1998 | Ljungberg | 428/698 |

FOREIGN PATENT DOCUMENTS

| | | |
|---|---|---|
| 492 049 | 7/1992 | European Pat. Off. . |
| 643 152 | 3/1995 | European Pat. Off. . |

OTHER PUBLICATIONS

Patent Abstracts of Japan, vol. 18, No. 392, C–1288, abstract of JP,A,6–108258 (Toshiba Tungaloy Co Ltd), Apr. 19, 1994.

Patent Abstracts of Japan, vol. 12, No. 297, C–519, abstract of JP,A,63–65079 (Mitsubushi Metal Corp), Mar. 23, 1988.

Patent Abstracts of Japan, vol. 17, No. 114, M–1377, abstract of JP,A,4–300104 (Mitsubushi Metal Corp), Oct. 23, 1992.

*Primary Examiner*—Archene Turner

*Attorney, Agent, or Firm*—Burns, Doane, Swecker & Mathis, L.L.P.

[57] ABSTRACT

The present invention relates to a cutting tool insert of a carbonitride alloy with titanium as the main component and containing tungsten and cobalt useful for machining, e.g., turning, milling and drilling of metal and alloys. The insert is provided with a coating of at least one wear resistant layer. The composition of the insert and the coating is chosen in such a way that a crack-free coating in a moderate (up to 1000 MPa) compressive residual stress state is obtained. The absence of cooling cracks in the coating, in combination with the moderate compressive stress, gives the tool insert improved properties compared to prior art tools in many cutting tool applications.

8 Claims, No Drawings

CVD-COATED TITANIUM BASED CARBONITRIDE CUTTING TOLL INSERT

BACKGROUND OF THE INVENTION

The present invention relates to a cutting tool insert of a carbonitride alloy with titanium as main component and containing tungsten and cobalt useful for machining, e.g., turning, milling and drilling, of metal and alloys. The insert is provided with at least one wear resistant layer free from cooling cracks, which in combination with a moderate compressive stress, gives the tool insert improved properties compared to prior art tools in several cutting tool applications.

WC-Co based alloys (cemented carbide) coated with one or more layers of a wear resistant material, e.g., TiC, Ti(C,N), TiN and $Al_2O_3$, are the dominating type of materials used for cutting tool inserts. The coatings are most often produced by employing chemical vapor deposition (CVD) techniques at relatively high deposition temperatures (700–1100° C.). One weakness of such CVD-coatings in combination with WC-Co alloys is that a network of cooling cracks are formed in the coating during cooling down the CVD-load after the coating run. The cracks are caused by the mismatch in thermal expansion between the WC-Co based alloy and the coating materials. The WC-Co alloy has a thermal expansion coefficient, $\alpha$, in the approximate range $4.6–6.7\cdot10^{-6}$° C.$^{-1}$, while typical values for the coating materials are $\alpha_{TiC}\approx7.6$, $\alpha_{TiN}\approx8.0$, $\alpha_{Ti(C,N)}\approx7.8$ and $\alpha_{\alpha\text{-}Al_2O_3}\approx7.8\cdot10^{-6}$° C.$^{-1}$. This means in all cases that the coating will contract more than the WC-Co alloy upon cooling to room temperature. This contraction leads to tensile stresses in the coating which in part are relaxed by the formation of the cooling cracks.

Cooling cracks may be detrimental to the performance of the cutting tool in certain machining applications for at least three reasons:

1. The cracks act as initiation sites both for comb cracks (cracks perpendicular to the cutting edge) and edge fracture.
2. The alloy, which generally is thermodynamically and chemically less stable than the coating, is exposed through the cracks to attack by cutting fluids, work piece material and the surrounding atmosphere.
3. Work piece material can be pressed into the cracks during the cutting operation, thus enlarging the initial cracks.

In addition, the residual tensile stresses in the coating may lead to spalling of the coating when used in a cutting operation.

CVD-coatings on inserts of WC-Co alloys result in a reduction in transverse rupture strength (TRS) of the cutting insert which negatively influences the toughness properties of the insert. It is thought that cooling cracks and tensile stresses in the coating are of importance for this reduction.

The problem of crack formation can to a certain extent be solved by employing low temperature coating processes such as physical vapour deposition (PVD), plasma assisted CVD or similar techniques. However, coatings produced by these techniques generally have inferior wear properties, lower adhesion and lower cohesiveness. Furthermore, although these techniques may be used to deposit TiC, Ti(C,N) or TiN coatings, so far it is not possible to deposit high quality $Al_2O_3$-coatings with good crystallinity. In the Swedish patent application 9304283-6 a method of producing essentially crack free coatings is disclosed. However, these coatings always have a specific 114-textured $\alpha$-$Al_2O_3$ layer with a certain grain size and grain shape (platelet type grains). These coatings on ordinary WC-Co alloys always possess tensile stresses.

It is generally known that a tensile residual stress in a coating can be reduced by a mechanical treatment of the coating, e.g., by shoot peening the coating with small steel balls or similar particles. The tensile stresses are released by inducing defects in the coating or by generating further cracks (see U.S. Pat. No. 123,934). Additional cracks are not desirable for conditions mentioned above and the positive effect of the induced defects will in many cases be lost during the cutting operation when the tool insert tip may reach very high temperatures (up to 1000° C.).

In U.S. Pat. No. 5,395,680 a method to obtain compressive stresses in a CVD-coating is disclosed. Onto a CVD-coating a second layer is deposited by the PVD-technique. The ion bombardment during the PVD-step induces compressive stresses in the coating. The drawback of such a process is, one, that it is an expensive two-step process and, second, it is very likely that the compressive stress state will be lost as soon as the PVD-layer is worn through.

Titanium-based carbonitride alloys, so-called cermets, are today well established as tool insert material in the metal cutting industry and they are predominantly used for finishing cutting operations. The alloys consist of carbonitride hard constituents embedded in 3–25 wt-% binder phase based on Co and/or Ni. In addition to Ti, group VIa elements, normally Mo and/or W and sometimes Cr, are added to facilitate wetting between binder and hard constituents and to strengthen the binder by means of solution hardening. Group IVa and/or Va elements, i.e., Zr, Hf, V, Nb and Ta, may also be added, mainly in order to improve the thermo-mechanical behavior of the material, e.g., its resistance against plastic deformation and thermal cracking (comb cracks). All these additional elements are usually added as carbides, nitrides and/or carbonitrides. The grain size of the hard constituents is usually <2 $\mu$m. The binder phase normally consists of mainly cobalt and/or nickel. The amount of binder phase is generally 3–25 wt%. Furthermore, other elements are sometimes used, e.g., aluminium, which are said to harden the binder phase and/or improve the wetting between hard constituents and binder phase.

Sintered cermets generally have a highly complex microstructure with a chemically heterogeneous hard phase far from thermodynamic equilibrium. The carbonitride grains typically have a characteristic core/rim structure where the cores may be remnants of the raw material powder and/or formed during sintering. The rims are formed both during solid state and liquid state sintering. Generally, several types of cores may be found within the same alloy. The rims most often have a large gradient in chemical composition, at least in the radial direction. The chemical composition and relative abundance of both cores and rims may be varied within large limits by proper choices of raw material powder (e.g., prealloyed powders) and processing conditions. This is true even if the macroscopic chemical composition is kept constant. These variations give rise to significant differences in the physical properties of the alloys and of course also in their performance as cutting tools.

Cermets are harder and chemically more stable than WC-Co based hard materials, but unfortunately also considerably more brittle. Due to this brittleness, they lack the reliability necessary to increase their area of application to any large degree towards more toughness demanding operations. Since CVD-coatings generally increase the brittleness of the material, CVD coated cermets have not been available on the market, most probably because coatings applied by this technique have been thought to further decrease their reliability. Instead, PVD-coated cermets have been used for certain applications demanding higher wear resistance than the alloy itself.

However, CVD-coated cermets are not unknown. Patents and patent applications published so far may be divided into two categories, those concerned with modifications of the alloy composition and those focusing on adhesion of the coating. When examining the former category one finds that the alloys described have invariably been modified in ways making them distinctly different from conventional cermets. For example, in U.S. Pat. No. 5,376,466 a CVD-coated carbonitride based material is described which allegedly has superior thermoplastic deformation resistance. In order to accomplish this, the amount of binder phase has been decreased considerably (0.2–3 wt%) compared to a conventional cermet (3–25 wt%) and an additional hard phase (5–30 wt% of zirconia or stabilized zirconia) has been added. Both the low binder content and the third phase makes this material very different from a conventional cermet.

In EP-A-0 492 059, a CVD-coated cermet is described which is claimed to have both superior wear resistance and fracture resistance. This has been accomplished by a complicated sintering process which gives rise to an increased hardness in the near surface zone of the alloy, accompanied by a tungsten enrichment and binder depletion in the same zone. Again, this makes the alloy distinctly different from a conventional cermet and also has the major disadvantage that the alloy cannot be ground to any large degree after sintering since this would remove the surface zone. Grinding the alloy after sintering is often desirable, in particular for milling inserts, in order to obtain a preferred final shape and size.

EP-A-0 440 157 and EP-A-0 643 152 fall into the second category of patents and patent applications. In these applications, different methods are described that produce sufficient adhesion between coatings and conventional cermets so that the superior wear resistance of the CVD-coating material can be utilised. In particular, it is claimed that a thin TiN or Ti(C,N) layer applied as a first coating layer onto the alloy acts as a sufficiently effective diffusion barrier for binder metal atoms to avoid, that these atoms interfere with the growth of subsequent layers.

The basis of the present invention is to combine essentially conventional CVD-coatings and conventional cermets in such a way that a dramatic increase in toughness is obtained.

OBJECTS AND SUMMARY OF THE INVENTION

It is an object of the present invention to provide a CVD-coated sintered titanium-based carbonitride alloy, where the coating is free from cooling cracks and has a moderate compressive residual stress which even further improves its properties, and a method for producing such alloys.

In one aspect of the invention, there is provided a sintered titanium-based carbonitride alloy which is coated to a total coating thickness of 1–20 $\mu$m comprising one or more wear resistant CVD-layers comprising carbides, nitrides, oxides and borides or combinations or solid solutions thereof of the elements Ti, Al, Zr, Hf, V, Nb, Ta, Cr, Mo, W, Si, and B, particularly $Al_2O_3$ and/or TiX, where X denotes C, N, O or any combination of these elements. The coating is free from cooling cracks and has a moderate compressive residual stress, in the range 0–1000 MPa. This material has superior toughness, wear resistance and chemical stability and is suitable as a cutting tool material.

In another aspect of the invention, there is provided a method of manufacturing a CVD-coated sintered carbonitride alloy in which the alloy consists of a titanium-based hard carbonitride phase and a binder based on cobalt and/or nickel. The composition of the alloy and the coating layers is chosen so that the difference in thermal expansion between the alloy and the coating materials is such that a moderate compressive stress is obtained in the coating at room temperature.

DETAILED DESCRIPTION OF THE PREFERRED EMBODIMENTS OF THE INVENTION

According to the present invention, a CVD-coated titanium-based carbonitride cutting tool insert with high toughness, wear resistance and chemical stability is provided. By carefully choosing the composition of the alloy in such a way that its thermal expansion is moderately higher than that of the coating materials, it has surprisingly turned out that an insert with greatly improved properties is obtained. In particular, the insert has both better wear resistance and dramatically better toughness compared to the uncoated alloy. Thus, applying a coating according to the invention, actually improves the reliability of the cutting tool insert.

While we do not wish to be bound to any theory, it is strongly believed that this has to do with the compressive residual stress obtained in the coating. First of all, all cooling cracks have been eliminated. Thus, there are no obvious initiation sites for cracks which would lead to edge fracture. In fact, the coating probably contains less defects than the alloy itself which in this way is protected from cracking, leading to increased reliability. Secondly, the action of the compressive stress in the coating is to close cracks running perpendicularly to the surface of the coating so that more energy is needed to propagate such cracks. In addition, the coating acts as a temperature barrier, which decreases the thermo-mechanical load on the alloy and thus even further improves its reliability. In particular, the formation of comb cracks, which are caused by fatigue due to high thermo-mechanical loading, may be delayed considerably.

During cutting, the moderate compressive stress in the coating at room temperature will decrease as the temperature in the cutting edge increases, but should never be allowed to change sign since this could lead to cracking. Fortunately, since the coating acts as a temperature barrier, the alloy will have a somewhat lower temperature than the coating. A cutting temperature higher than the CVD deposition temperature can therefore be accepted. Nevertheless, for high cutting temperatures, e.g., for finishing with high cutting speed, a large difference in thermal expansion coefficient should be chosen in order to ensure that a sufficient compressive stress is maintained which reduces the risk for crack propagation through the coating. On the other hand, the stress should not be too high at room temperature since this increases the risk of spalling both in the initial and final stage of each cutting sequence. It is our belief that the average compressive stress of the layer or layers with a thickness >1 $\mu$m in the coating at room temperature shall be in the range more than zero and up to 1000 MPa, preferably 100–800 MPa, most preferably 200–500 MPa. However, the optimum stress must be determined experimentally for each cutting application area.

The residual stress is determined by X-ray diffraction using the well-known $\sin^2\psi$-method. Under the reasonable assumption that the normal stress component perpendicular to the plane of the coating is close to zero, the method can be used to determine the full stress tensor. However, since it turns out that the shear stress components generally are low as well (typically less than 100 MPa) it is sufficient to characterize the stress state as the mean value of three measurements, 120° apart, of the stress in the plane of the coating. The method can only discriminate between layers of different crystal structure. Thus, if several layers of the same crystal structure are present in the coating, the result obtained will be the average value for these layers. The stress, however, may well vary between individual layers depending on differences in chemical composition, crystal structure and deposition temperature.

A theoretical estimate of the residual stress in the coating at a temperature $T_2$ (e.g., room temperature) may in principle be obtained using the following equation:

$$\sigma = E_{coating}\frac{\alpha_{coating} - \alpha_{sub}}{1 - \nu_{coating}}(T_1 - T_2) \quad (1)$$

where $\sigma$ is the average residual stress in the plane of the coating, $\alpha_{coating}$ and $\alpha_{sub}$ are the thermal expansion coefficients of the coating and the alloy respectively, $\nu_{coating}$ is Poisson's ratio for the coating, $T_1$ is the deposition temperature and $E_{coating}$ is Young's modulus for the coating. When scrutinizing this equation one may observe that $\nu_{coating}$, $E_{coating}$ and to some extent $T_1$ are fairly constant for the coatings of interest while dramatic effects may be obtained by varying $\alpha_{coating}-\alpha_{sub}$.

This equation can be used to predict the effect changes in alloy and coating microstructure and chemistry would have on the average residual stress. Unfortunately, because no literature data on thermal expansion coefficients of the complex phases in a cermet alloy exist and the complex microstructure of cermets the thermal expansion coefficients of cermet alloys must be determined experimentally.

Generally, in cermet alloys an increase in N and/or binder phase content will increase the thermal expansion coefficient whereas an increase in W content will decrease it. If Ti in the cermet alloy is partly replaced by other elements commonly used in cermet alloys, e.g., Ta, Nb, V, Hf, Zr, Mo, Cr, this will also result in a decrease in the thermal expansion coefficient. Ti should however, always remain the main component of the alloy, which means that the content of Ti in atomic-% is higher than the content of any other element in the alloy.

For TiX coatings, where X denotes C, N, O or any stoichiometric as well as nonstoichiometric combination of these elements, an increase in N content will increase the thermal expansion coefficient. If Ti in the coating is partly or fully replaced by Ta, Nb, V, Hf, Zr or W the thermal expansion coefficient decreases. Alternative coatings containing Si and/or B may be used for further optimization.

In this way, several alternative routes for designing alloy/coating combinations which yield well-defined compressive stresses in the coatings are available. However, in order to obtain a suitable cutting tool material one must also consider other parameters. The amount of binder phase in a cermet should be in the range 3–18 vol%, preferably in the range 6–15 vol%, in order to ensure a suitable combination of toughness and wear resistance. Similarly, it is believed that the atomic fractions of C and N in the alloy should satisfy the relation $0<N/(N+C)<0.6$, preferably $0.1<N/(N+C)<0.6$. The atomic fractions of W and Ti in the alloy should satisfy the relation $0<W/(Ti+W)<0.4$. The combination of these elements and others discussed above that gives both a desired compressive residual stress in the coating and suitable other properties may be determined experimentally by the skilled artisan.

If the beneficial effects of the wear resistant coating with the toughness enhancing compressive residual stress are to be utilized one must make sure that a high quality coating can be deposited. Thus, it is necessary to ensure that no elements, in particular Ni, if present in the alloy which elements severely disturb the growth of the CVD-layers, have the possibility to diffuse into the growing layer. It has been found that similar to what has been described in U.S. Pat. No. 5,135,801 and Swedish patent application 9400951-1, an incorporation of a thin layer (0.2–2 mm) of TiCO or TiCON in the inner part of the coating structure will significantly reduce the nickel diffusion. It is therefore recommended to use such diffusion barrier layers whenever the cermet alloy contains more than 0.5 at-% nickel. A more preferred alternative is to use a suitable, essentially Ni free cermet alloy as described, e.g., in Swedish patent application 9500236-6. Such alloys that have been found to perform particularly well when provided with a coating with properties according to the invention are manufactured from TiN, Ti(C,N), (Ti,W)C, (Ti,W)(C,N) and/or WC together with Co as binder phase to a total composition consisting of Ti, W, Co, N and C the atomic fractions of which satisfying the relations $0.3<N/(C+N)<0.5$, $0.05<W/(W+Ti)<0.12$, preferably $0.07<W/(W+Ti)<0.11$ and $0.07<Co<0.15$, preferably $0.1<Co<0.13$. Ti may partly be replaced by Ta, Nb, V, Zr, Hf and/or Mo in an amount of <5 at-%, preferably <3 at-%, of each and totally <12 at-%, preferably <10 at-%.

The invention is additionally illustrated in connection with the following Examples which are to be considered as illustrative of the present invention. It should be understood, however, that the invention is not limited to the specific details of the Examples.

EXAMPLE 1

A powder mixture was manufactured from (wt %)64.5% $Ti(C_{0.67}N_{0.33})$, 18.1% WC and 17.4% Co. The powder mixture was wet milled, dried and pressed into inserts of the type SEMN 1204AZ which were dewaxed and then vacuum sintered at 1430° C. for 90 minutes using standard sintering techniques. This is a cermet manufactured according to Swedish patent application 9400951-1 which is characterized by optimized toughness at the expense of some wear resistance. It is a suitable alloy both because the wear resistance is expected to increase with a CVD-coating and because it does not contain nickel which simplifies the coating process. Of the total number of inserts, one-half (henceforth denoted material A) was coated with the following layer structure: 1 mm TiC, 0.5 mm TiCO, 7 mm Ti(C,N), 6 mm of 012-textured $\alpha$-$Al_2O_3$ and a 1 mm layer of TiN on top, using a CVD-process as disclosed in the Swedish patent application 9400951-1. The other half (denoted material B) was coated using a different process with an inner layer of 5 mm of Ti(C,N) deposited at a lower temperature (850° C.) and a 4 mm outer layer of 012-textured a-$Al_2O_3$ according to Swedish patent application 9501286-0. The coating surface was smoothed by brushing the insert edges with SiC-brushes.

The residual stress was then measured on the top surface of the inserts using X-ray diffractometry (XRD, $\sin^2\psi$-method) and the parameters given in Table 1.

TABLE 1

| Coating | h | k | l | 2 q | Young's modulus | Poisson's ratio |
|---|---|---|---|---|---|---|
| Ti (C, N) | 3 | 3 | 3 | 137, 7 | 490000 MPa | 0, 200 |
| a-$Al_2O_3$ | 1 | 4 | 6 | 135, 8 | 421941 MPa | 0, 253 |

The results of the measurements are given in table 2. The normal stress in the plane of the coating is the average of three measurements 120° apart in the plane of the coating.

TABLE 2

| Material | coating | normal stress, MPa |
|---|---|---|
| A | Ti (C, N) | −460 |
| | a-$Al_2O_3$ | −270 |
| B | Ti (C, N) | −340 |
| | a-$Al_2O_3$ | −430 |

Clearly, both the inner layer of Ti(C,N) and the $\alpha$-$Al_2O_3$ layer have a compressive stress in the preferred range.

From both materials, polished cross sections of coating and alloy were prepared and the coatings were examined using optical microscopy and scanning electron microscopy (SEM). According to our experience, cooling cracks can easily be found using any one of these techniques in CVD-coatings deposited on regular WC-Co based alloys. However, no cooling cracks were possible to find in any coated insert produced according to the invention.

EXAMPLE 2

In order to verify that the measured stresses in Example 1 are reasonable, equation (1) above can be used. The thermal expansion coefficient for the alloy of Example 1 was determined using a test bar of suitable size and dimension and found to be about $8.5 \cdot 10^{-6\circ}$ C.$^{-1}$. For the parameters needed to describe the coating, literature data according to Table 3 were used for this rough calculation giving an estimated average residual stress in the coating of −432 MPa , which is in relatively good agreement with the experimental results in Example 1.

TABLE 3

| parameter | Ti (C, N) | $Al_2O_3$ |
|---|---|---|
| $^{\alpha}$coating | $7.8 \cdot 10^{-6} \cdot {}^{\circ}$ C.$^{-1}$ | $7.8 \cdot 10^{-6} \cdot {}^{\circ}$ C.$^{-1}$ |
| $^{\nu}$coating | 0.20 | 0.25 |
| E coating | 420000 MPa | 490000 MPa |

EXAMPLE 3

In order to study the wear resistance of inserts manufactured according to Example 1 above, inserts in the geometry TNMG 160408-MF were manufactured. Three different references were included in the test. As reference 1, inserts of the type TNMG 160408-MF were manufactured of a powder mixture consisting of (in weight-%) 10.8 Co, 5.4 Ni, 19.6 TiN, 28.7 TiC, 6.3 TaC, 9.3 $MO_2C$, 16.0 WC and 3.9 VC. This is a well-established cermet grade (henceforth denoted ref. 1) within the P25-range for turning and is characterized by a well-balanced behavior concerning wear resistance and toughness.

As reference 2, inserts of the same geometry were manufactured of a powder mixture consisting of (in weight-%) 11.0 Co, 5.5 Ni, 26.4 (Ti,Ta)(C,N), 11.6 (Ti,Ta)C, 1.4 TiN, 1.8 NbC, 17.7 WC, 4.6 $Mo_2C$ and 0.3 carbon black. These inserts were coated with an about 4 $\mu$m thick Ti(C,N)-layer and a less than 1 $\mu$m thick TiN-layer using physical vapour deposition technique (PVD). This is a well-established PVD-coated cermet grade (denoted ref. 2) within the P25-range for turning and is preferably used for operations demanding high wear resistance. As reference 3, uncoated alloys (denoted ref. 3) identical to, and taken from the same batch as those used for producing materials A and B, were used.

The wear resistance test (longitudinal turning) was performed using the following cutting data:

Work piece material: Ovako 825B speed: 250 m/minute feed: 0.2 mm/rev.

depth of cut: 1.0 mm

Coolant: yes

Two edges of each alloy were tested. Flank wear (VB) and crater wear area ($k_a$) were measured continuously and the test was run until end of tool life was reached. The tool life criterion was edge fracture (EF) due to excessive crater wear or flank wear VB>0.3 mm. The result, expressed in terms of relative figures, is given in Table 4.

TABLE 4

Result of the wear resistance test.

| material | resistance against flank wear | resistance against crater wear | relative tool life | tool life criterion |
|---|---|---|---|---|
| ref. 1 | 1.0 | 1.0 | 1.0 | EF |
| ref. 2 | 1.97 | 4.08 | 1.75 | VB |
| ref. 3 | 0.84 | 1.17 | 1.02 | EF |
| A | 1.58 | 6.94 | 2.78 | VB |
| B | 1.86 | 6.94 | 3.27 | VB |

Clearly, both material A and material B have superior tool life compared to the references. This is due to their high resistance against crater wear. It should be noted that the measurements of flank and crater wear were done after 10 minutes cutting time. This time was chosen because all alloys were far from end of tool life even though a well-defined wear pattern had been developed. However, due to their thicker coatings, materials A and B have a larger edge radius than the references, and this leads to a higher initial flank wear. Close to the end of tool life these two alloys showed significantly better resistance against flank wear as well. Note also that the uncoated alloy (ref. 3) has about the same wear resistance as the conventional cermet (ref. 1).

EXAMPLE 4

In order to investigate the toughness behavior of the same inserts as in Example 3 (including the same references) a heavy, interrupted turning test was carried out under the following conditions:

Work piece material: SS 2234 speed: 250 m/minute feed: 0.3 mm/rev.

depth of cut: 0.5 mm

Coolant: yes

Three edges of each alloy were tested. All edges were run to fracture . The result is given in Table 5.

TABLE 5

| Material | Result of the toughness test: average number of cuts | relative tool life |
|---|---|---|
| ref. 1 | 21 | 1.0 |
| ref. 2 | 45 | 2.1 |
| ref. 3 | 63 | 3.0 |
| A | 184 | 8.8 |
| B | 220 | 10.5 |

Clearly, both materials A and B, produced according to the invention, show substantially better toughness than the references. In particular, both materials show better toughness than the uncoated alloy, ref. 3. Thus, this example shows that by applying a CVD-coating onto a cermet with properties according to the invention, which is generally believed to decrease the toughness of the insert, a considerably tougher product is obtained. In addition, as demonstrated in Example 3, a substantial increase in wear resistance is obtained.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A cutting tool insert of titanium-based carbonitride provided with a 1–20 $\mu$m thick coating, said coating comprising one or more wear resistant CVD-layers comprising carbides, nitrides, oxides and borides or combinations or solid solution thereof of the elements Ti, Al, Zr, Hf, V, Nb, Ta, Cr, M, W, Si and B, wherein the coating is free from cooling cracks and that the CVD-layer or -layers with the same crystal structure and with a thickness >1 $\mu$m of the coating have a compressive residual stress at room temperature of 100–800 MPa.

2. The cutting tool insert of claim 1 wherein said compressive residual stress is 200–500 MPa.

3. The cutting tool insert of claim 1 wherein the inner part of the coating structure contains a Ni diffusion barrier consisting of a 0.2–2 $\mu$m layer of TiCO or TiCON.

4. The cutting tool insert of claim 1 wherein the said cutting tool also comprises a binder phase essentially free from Ni.

5. The cutting tool insert of claim 1 wherein the atomic fractions of C and N satisfy the relation $0<N/(N+C)<0.6$, and that the atomic fractions of W and Ti satisfy the relation $0<W/(Ti+W)<0.14$.

6. The cutting tool insert of claim 1 wherein titanium-based carbonitride consists of C, N, Ti, W and Co, the atomic fraction of said elements satisfying the relations $0.25<N/(C+N)<0.5$, $0.05<W/(W+Ti)<0.11$ and $0.09<Co<0.14$.

7. The cutting tool insert of claim 5 wherein Ti in said titanium-based carbonitride is partly replaced by Ta, Nb, V, Zr, Hf and/or Mo in such an amount of <5 at-% of each and in a total amount of <15 at-%.

8. The cutting tool insert of claim 5 wherein the atomic fractions of C and N are $0.1<N/(N+C)<0.6$.

* * * * *